US007101192B1

(12) United States Patent
Bordeau et al.

(10) Patent No.: US 7,101,192 B1
(45) Date of Patent: Sep. 5, 2006

(54) SECONDARY LOCKING DEVICE FOR A MULTI-PIN CONNECTOR

(75) Inventors: James Bordeau, Sidney, NY (US); Larry Sweet, Port Crane, NY (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 11/144,597

(22) Filed: Jun. 6, 2005

(51) Int. Cl.
*H01R 12/00* (2006.01)

(52) U.S. Cl. ..... 439/66; 439/752

(58) Field of Classification Search ..... 439/595, 439/752, 594, 598
See application file for complete search history.

(56) References Cited

U.S. PATENT DOCUMENTS 5,071,369 A * 12/1991 Denlinger et al. ..... 439/595
5,538,445 A * 7/1996 Grzybowski et al. ..... 439/752
5,730,624 A * 3/1998 Lester et al. ..... 439/595
6,045,413 A * 4/2000 Creux ..... 439/752
6,764,351 B1 * 7/2004 Finzer et al. ..... 439/752
6,945,829 B1 * 9/2005 Finzer et al. ..... 439/752
2003/0040228 A1 * 2/2003 Finzer et al. ..... 439/752
2004/0053528 A1 * 3/2004 Kainz et al. ..... 439/310
2004/0171317 A1 * 9/2004 Finzer et al. ..... 439/752

* cited by examiner

*Primary Examiner*—James R. Harvey
(74) *Attorney, Agent, or Firm*—Blank Rome LLP

(57) ABSTRACT

A secondary lock that can be used for multi-pin electrical connectors is disclosed. The secondary lock comprises a modular, non-conducting, one piece plastic insert that can be suitably adapted to interconnect with a primary lock of the multi-pin electrical connecter. The insert includes a plurality of fingers and pin cavities that support and align pins of the multi-pin electrical connector. A centrally located centering post may be used for positioning and aligning the insert within the multi-pin electrical connector, juxtaposed to the primary lock. The secondary lock may be used for both cylindrical and rectangular type multi-pin electrical connectors. The secondary lock holds the pins of the multi-pin electrical connector in place, even in the event of total failure of the primary lock.

15 Claims, 2 Drawing Sheets

SECONDARY LOCKING DEVICE FOR A MULTI-PIN CONNECTOR

FIELD OF THE INVENTION

The present invention is generally related to multi-pin electrical connectors and, more particularly, is related to a secondary lock that may be used to hold the contacts of a multi-pin electrical conductor in place.

BACKGROUND OF THE INVENTION

Many multi-pin electrical connectors comprise a socket and a plug, each of which is composed of a socket body and a plug body inside which both house a block of insulating material together with the male or female connecting pins.

In many such connectors, a ring is mounted on the plug body by being screw threaded or by means of cams, sloped so that rotation of the ring, engaged on ribs on the socket body simultaneously causes the plug body to move towards the socket body with maximum insertion of the male pins into the female pins.

In order to permit that assembly, the male and female pins occupy precise radial and angular positions so that each male pin can be placed in the axis of its corresponding female pin, to the exclusion of any other position and, to this end, matching alignment grooves are provided on the socket and plug bodies.

However, in order to permit assembly of the plug on the socket, it is also necessary for the ring to occupy a precise angular position in relation to the plug on the socket. Otherwise, there could be an incomplete insertion of the male pins into the female pins.

In a typical multi-pin connector, a pin of each terminal projects forward from each terminal cavity and into a common blind bore or chamber defined by a forward projecting circumferential encasement or shroud of the male connector portion. The female connector portion of the electrical connector houses the series of pin receptacles which communicate through a leading end of the female connector portion. For a reliable electrical connection, each pin receptacle must align with its respective pin of the terminal of the male connector portion. When the electrical connector is mated, the leading end portion of the female connector portion fits into the chamber of the male connector portion and is thus guided by the circumferential encasement.

However, during the manufacturing phase and/or handling of a wire harness, which is engaged to the male connector portion of the multi-pin electrical connector, the exposed protruding pins of the terminals can potentially be knocked or bent, or debris may enter the chamber of the male connector portion which results in the inability of the terminals to connect electronically within the pin receptacles of the female connector portions. Moreover, the manufacturing dimensional variances between the terminals and the male connector portion housing may cause the terminals to pivot slightly within the housing, and the distal ends of the pins to become misaligned with the receptacles.

To prevent the movement of the pins many electrical connectors use a primary lock. The primary lock is adapted to accommodate a plurality of pins in the electrical connector and, in the instances where numerous pins are used, a plurality of primary locks may be used. However, very often, the primary lock may become damaged or worn and the pins are again susceptible to damage caused by bending and misalignment.

Thus, a need exists in the art to address the aforementioned deficiencies and inadequacies associated with the loss of a primary lock in a multi-pin electrical connector to maintain stability and integrity of the pins.

SUMMARY OF THE INVENTION

Embodiments of the present invention provide a secondary lock for a multi-pin electrical connector that can be used to secure the pins in the connector with and without the loss of the primary lock.

Briefly described, in a preferred embodiment of the invention, a modular, non-conducting, one piece secondary lock may be used. The secondary lock comprises an insert that is suitably adapted to interconnect with the primary lock of the multi-pin electrical connector. A plurality of inserts may be used depending upon the number of pins in the electrical connector. In the preferred embodiment, a 6-pin cluster is used per each secondary lock.

The insert includes a plurality of fingers that support the pins in the connector. A plurality of pin cavities in the insert seat the pins and assist in the support of the pins in the connector. A centering post in the insert may be used to position, manipulate and align the insert at one end of the primary lock when it is juxtaposed to a female mating connector.

Embodiments of the present invention can also be viewed as a method for providing a secondary locking device that can be used in multi-pin electrical connectors. In that regard, one embodiment of such a method uses the secondary lock as described above.

Other systems, methods, features, and advantages of the present invention will become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWING

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

Figure 1:
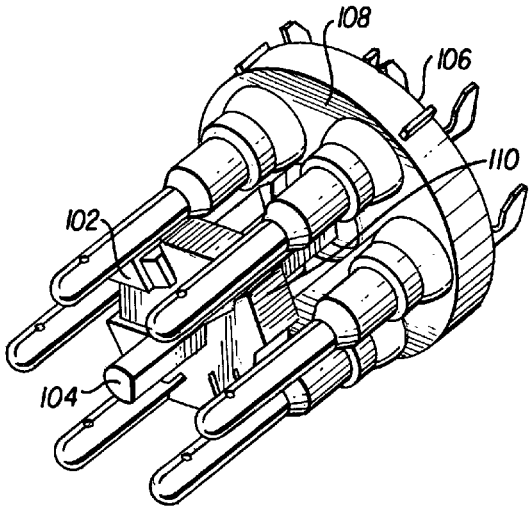
FIG. 1 is a perspective drawing illustrating a preferred embodiment of the invention.
Figure 2:
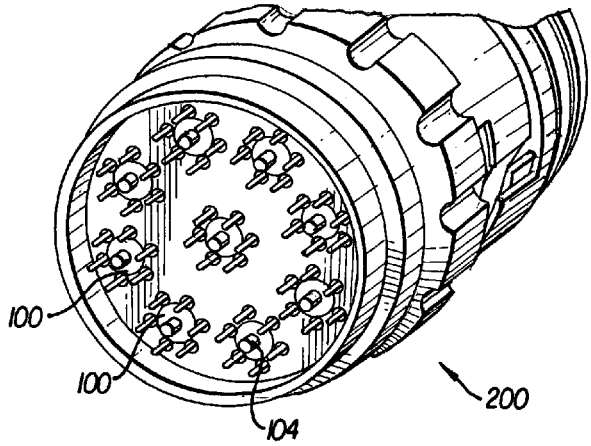
FIG. 2 is a perspective drawing of a multi-pin electrical connector with a plurality of secondary locks supporting a plurality of electrical pins.

FIG. 1 illustrates a preferred embodiment of the present invention. In FIG. 1, a secondary lock is used in a multi-pin electrical connector. The secondary lock comprises a modular, non-conducting, one piece plastic insert 102 that is suitably adapted to interconnect with a primary lock 106 of the multi-pin electrical connector as described above. The insert 102 may be adapted to accommodate both cylindrical and rectangular multi-pin electrical connectors. The number of inserts 102 that may be used depends upon the number of pins in the electrical connector. FIG. 2 illustrates a multi-pin electrical connector 200 with 54 pins and 9 secondary locks 100.

Figure 3:
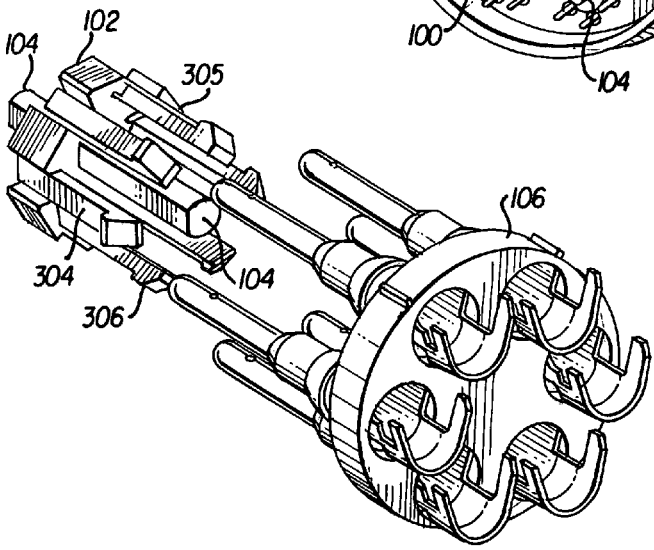
FIG. 3 is a perspective view of the preferred embodiment interfaced with a primary lock.

In FIG. 3, the secondary lock includes a plurality of fingers 304 that are integral to the insert 102 and support the pins of the multi-pin electrical connector. The fingers 304 extend toward one face 108 of the primary lock 106. As shown in FIG. 3, the fingers 304 are recessed radially inwardly to form a plurality of pin cavities 110, within front portions 305 of the insert 102. By seating the pins in their respective pin cavities 110 the pins are supported along their longitudinal axis and thus, protected from bending or torsional forces. A centrally located centering post 104 that is also integral to the insert 102, and is longer in length than the pins, may be used for manipulating, positioning and aligning the insert 102 with the pins during an installation operation. The centering post 104 has a D-shaped or other non-circular profile. The D-shaped profile facilitates easy handling and allows one end of the centering post 104 to be secured in a corresponding slot (not shown) in a mating multi-pin socket to properly position the connector for mating. The centering post 104 is continued on both sides of the insert 102.

Figure 4:
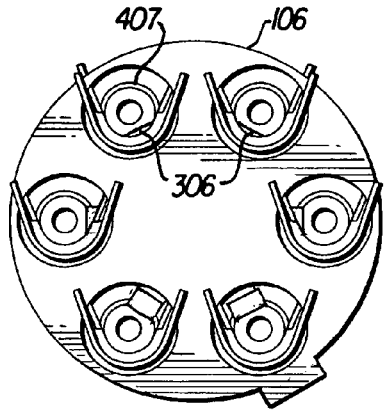
FIG. 4 is a perspective end view of the primary lock with the preferred embodiment interconnected at one end.

A detent 306 integral to the free end of each finger 304 may be used for interlocking the finger 304 with the primary lock 106. The detent 306 may be snapped into a preformed slot 407 located on an external face 108 of the primary lock 106 and extending therethrough (FIG. 4). The primary lock 106 is manufactured to include the preformed slot 407.

Figure 5:
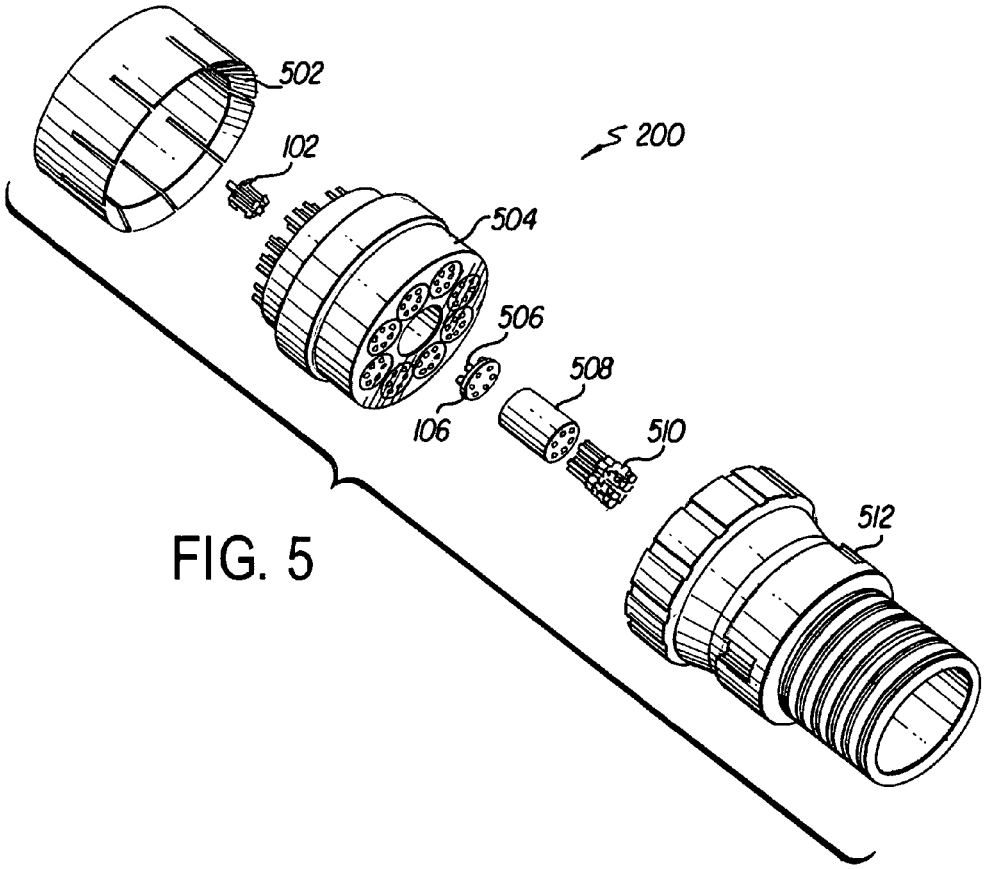
FIG. 5 is an exploded perspective view of a multi-pin electrical connector illustrating the positioning of the preferred embodiment in conjunction with the primary lock.

FIG. 5 illustrates the positioning of the secondary lock as it is aligned in the multi-pin electrical connector 200 juxtaposed to the primary lock 106. In FIG. 5, a pin cluster 510 with 6 pins is inserted into a grommet 508. The pins extend beyond the grommet 510 and are secured at one end by the primary lock 106. The grommet 508, with the enclosed pins and the attached primary lock 106, is inserted into a plug shell 504 that houses a plurality of pins grouped and arranged in their respective clusters. The pins extend beyond the plug shell 504 and are further secured by the secondary lock 102. A coupling nut 502 at one end and an adapter 512 at the other end encapsulate and secure the plug shell 504. The secondary lock is used to hold the pins of the multi-pin electrical connector in place, even in the event of total failure of the primary locking mechanism.

The secondary lock may be used with multi-pin electrical connectors with 6 pins as well as 54 pins.

It should be emphasized that the above-described embodiments of the present invention, particularly, any preferred embodiments, are merely possible examples of implementations, merely set forth for a clear understanding of the principles of the inventions. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. A secondary lock for a multi-pin electrical connector, comprising:

a modular, non-conducting, one piece insert suitably adapted to interconnect with a primary lock of the multi-pin electrical connector;

a plurality of fingers integral to said insert that support pins of the multi-pin electrical connector, wherein the plurality of fingers are spaced apart from each other;

a plurality of pin cavities, integral and associated with front portions of said plurality of fingers, that seat the pins; and a centering post integral to said insert for manipulating, positioning and aligning said insert at one end of the primary lock, wherein the centering post is located at the center of the insert and is spaced apart from the plurality of fingers; such that a gap is formed between the centering post and the fingers.

2. The secondary lock according to claim 1, wherein said insert, said plurality of fingers, said plurality of pin cavities and said centering post are molded plastic.

3. The secondary lock according to claim 1, further comprising a detent integral to, and located at one end of each finger, for interlocking with the primary lock.

4. The secondary lock according to claim 3, wherein said detent is adaptively configured to snap into the primary lock.

5. The secondary lock according to claim 1, wherein said insert accommodates a cylindrical multi-pin electrical connector.

6. The secondary lock according to claim 1, wherein said insert accommodates a rectangular multi-pin electrical connector.

7. The secondary lock according to claim 1, wherein said centering post is adaptively structured at one end to coincide with a mating slot of a multi-socket electrical connector.

8. The secondary lock according to claim 1, wherein said centering post is adaptively structured at one end to rest on a face of the primary lock.

9. The secondary lock according to claim 5, wherein said insert accommodates a cylindrical 6-pin electrical connector.

10. The secondary lock according to claim 6, wherein said insert accommodates a rectangular 6-pin electrical connector.

11. The secondary lock according to claim 9, wherein a plurality of inserts are used to accommodate a 54-pin electrical connector.

12. The secondary lock according to claim 10, wherein a plurality of inserts are used to accommodate a 54-pin electrical connector.

13. A method for providing a secondary lock for a multi-pin electrical connector, said method comprising the steps of:

providing at least one insert suitably adapted to accommodate pins of the multi-pin electrical connector;

interconnecting the at least one insert to at least one primary lock of the multi-pin electrical connector;

supporting the pins with a plurality of spaced apart fingers that are integral to each insert;

seating the pins in a plurality of pin cavities that are integral to, and correspond to free ends of said plurality of fingers; and positioning the at least one insert at one end of the primary lock using a centrally located centering post that is integral to said insert, wherein the centering post is located at the center of the insert and is spaced apart from the plurality of fingers; such that a gap is formed between the centering post and the fingers.

14. The method according to claim 13, including the further step of interlocking the primary lock using a detent located at one end of each finger.

15. The method according to claim 14, including the further step of snapping the detent into the primary lock.

* * * * *

UNITED STATES PATENT AND TRADEMARK OFFICE

CERTIFICATE OF CORRECTION

PATENT NO. : 7,101,192 B1
APPLICATION NO. : 11/144597
DATED : September 5, 2006
INVENTOR(S) : James Bordeau et al.

It is certified that error appears in the above-identified patent and that said Letters Patent is hereby corrected as shown below:

Col. 3, line 34, after "grommet" change "510" to --508--.

Signed and Sealed this

Fifth Day of June, 2007

JON W. DUDAS
*Director of the United States Patent and Trademark Office*